US008454478B2

(12) United States Patent
Giannelli et al.

(10) Patent No.: US 8,454,478 B2
(45) Date of Patent: Jun. 4, 2013

(54) VERTICAL ARC EXERCISE MACHINE

(75) Inventors: Raymond Giannelli, Franklin, MA (US); Scott Lee, Pomfret, CT (US); Gordon Andrade, Northbridge, MA (US)

(73) Assignee: Cybex International, Inc., Medway, MA (US)

( * ) Notice: Subject to any disclaimer, the term of this patent is extended or adjusted under 35 U.S.C. 154(b) by 659 days.

(21) Appl. No.: 12/053,234

(22) Filed: Mar. 21, 2008

(65) Prior Publication Data

US 2008/0287265 A1 Nov. 20, 2008

Related U.S. Application Data

(63) Continuation-in-part of application No. 10/294,017, filed on Nov. 13, 2002, now abandoned, and a continuation-in-part of application No. 10/806,833, filed on Mar. 22, 2004, now Pat. No. 8,025,609, and a continuation-in-part of application No. 29/276,253, filed on Jan. 19, 2007, now Pat. No. Des. 563,489, and a continuation-in-part of application No. 29/276,249, filed on Jan. 19, 2007, now Pat. No. Des. 564,051.

(60) Provisional application No. 60/019,691, filed on Jan. 8, 2008, provisional application No. 60/337,498, filed on Nov. 13, 2001, provisional application No. 60/896,570, filed on Mar. 23, 2007.

(51) Int. Cl.
*A63B 22/04* (2006.01)

(52) U.S. Cl.
USPC ..... 482/52; 482/51; 482/53

(58) Field of Classification Search
USPC .... 482/51, 52, 53, 57, 70, 71, 79, 80; 601/23, 601/27, 33, 34, 35
See application file for complete search history.

(56) References Cited

U.S. PATENT DOCUMENTS

| | | | | |
|---|---|---|---|---|
| 326,247 | A | 9/1885 | Root | |
| 1,990,124 | A | 2/1935 | Kabisius | |
| 2,019,224 | A | 10/1935 | Hess | |
| 2,109,775 | A | 9/1938 | Hudson | |
| 3,756,595 | A | 9/1973 | Hague | |
| 3,791,646 | A | 2/1974 | Marchignoni | |
| 4,861,023 | A | 8/1989 | Wedman | |
| 5,039,088 | A * | 8/1991 | Shifferaw | 482/51 |
| 5,242,343 | A | 9/1993 | Miller | |
| 5,279,529 | A | 1/1994 | Eschenbach | |
| 5,383,829 | A | 1/1995 | Miller | |

(Continued)

FOREIGN PATENT DOCUMENTS

| | | |
|---|---|---|
| CA | 2 407 758 | 11/2004 |
| DE | 229712 | 10/1923 |

(Continued)

*Primary Examiner* — Glenn Richman
(74) *Attorney, Agent, or Firm* — Novak Druce Connolly Bove & Quigg LLP

(57) ABSTRACT

An exercise device comprising:

a foot support arranged on a frame for supporting a user standing upright on the foot support, the foot support being movable on the frame back and forth between a rearward position and a forward position along any one of a plurality of separate, reproducible user selectable segments of an overall arcuate path;

the foot support being supported in a cantilevered arrangement on a rear linkage that is pivotally mounted on the frame for back and forth movement.

18 Claims, 9 Drawing Sheets

U.S. PATENT DOCUMENTS

| | | | | | |
|---|---|---|---|---|---|
| 5,391,130 | A | | 2/1995 | Green | |
| 5,496,235 | A | | 3/1996 | Stevens | |
| 5,562,574 | A | | 10/1996 | Miller | |
| 5,584,781 | A | | 12/1996 | Chen | |
| 5,605,521 | A | | 2/1997 | Hsieh | |
| 5,611,756 | A | * | 3/1997 | Miller | 482/52 |
| 5,643,153 | A | | 7/1997 | Nylen et al. | |
| 5,655,998 | A | | 8/1997 | Yu | |
| 5,681,244 | A | | 10/1997 | Hsieh | |
| 5,685,804 | A | | 11/1997 | Whan-Tong et al. | |
| 5,707,320 | A | | 1/1998 | Yu | |
| 5,720,698 | A | | 2/1998 | Dalebout et al. | |
| D393,027 | S | * | 3/1998 | Chen | D21/670 |
| 5,788,610 | A | | 8/1998 | Eschenbach | |
| 5,792,027 | A | | 8/1998 | Gvoich | |
| 5,833,584 | A | | 11/1998 | Piaget et al. | |
| 5,857,940 | A | | 1/1999 | Husted | |
| 5,876,307 | A | | 3/1999 | Stearns et al. | |
| 5,879,271 | A | | 3/1999 | Stearns et al. | |
| 5,895,339 | A | | 4/1999 | Maresh | |
| 5,910,072 | A | | 6/1999 | Rawls et al. | |
| 5,913,751 | A | | 6/1999 | Eschenbach | |
| 5,916,064 | A | | 6/1999 | Eschenbach | |
| 5,921,894 | A | | 7/1999 | Eschenbach | |
| 5,957,814 | A | | 9/1999 | Eschenbach | |
| 5,993,359 | A | | 11/1999 | Eschenbach | |
| 6,004,244 | A | | 12/1999 | Simonson | |
| 6,024,676 | A | | 2/2000 | Eschenbach | |
| 6,027,430 | A | | 2/2000 | Stearns et al. | |
| 6,036,622 | A | | 3/2000 | Gordon | |
| 6,042,512 | A | | 3/2000 | Eschenbach | |
| 6,045,488 | A | | 4/2000 | Eschenbach | |
| 6,053,847 | A | | 4/2000 | Stearns et al. | |
| 6,077,196 | A | | 6/2000 | Eschenbach | |
| 6,077,198 | A | | 6/2000 | Eschenbach | |
| 6,090,013 | A | | 7/2000 | Eschenbach | |
| 6,090,014 | A | | 7/2000 | Eschenbach | |
| 6,126,573 | A | | 10/2000 | Eschenbach | |
| 6,135,926 | A | | 10/2000 | Lee | |
| 6,142,915 | A | | 11/2000 | Eschenbach | |
| 6,168,552 | B1 | | 1/2001 | Eschenbach | |
| 6,210,305 | B1 | | 4/2001 | Eschenbach | |
| 6,217,485 | B1 | | 4/2001 | Maresh | |
| 6,248,044 | B1 | | 6/2001 | Stearns et al. | |
| 6,277,054 | B1 | | 8/2001 | Kuo | |
| D450,101 | S | | 11/2001 | Hsu | |
| 6,361,476 | B1 | | 3/2002 | Eschenbach | |
| 6,551,218 | B2 | | 4/2003 | Goh | |
| 6,648,801 | B2 | | 11/2003 | Stearns et al. | |
| 6,761,665 | B2 | * | 7/2004 | Nguyen | 482/51 |
| 7,520,839 | B2 | * | 4/2009 | Rodgers, Jr. | 482/52 |
| 7,530,926 | B2 | * | 5/2009 | Rodgers, Jr. | 482/52 |
| 2003/0092532 | A1 | | 5/2003 | Giannelli et al. | |
| 2008/0261780 | A1 | * | 10/2008 | Giannelli et al. | 482/52 |

FOREIGN PATENT DOCUMENTS

| | | |
|---|---|---|
| FR | 498.150 | 12/1919 |
| FR | 498150 | 12/1919 |
| WO | WO 95/00209 | 1/1995 |
| WO | WO 96/08292 | 3/1996 |

* cited by examiner

VERTICAL ARC EXERCISE MACHINE

RELATED APPLICATIONS

This application claims the benefit of priority to U.S. Provisional Application Ser. No. 60/896,570 filed Mar. 23, 2007 and also to U.S. Provisional Application Ser. No. 61/019,691 filed Jan. 8, 2008 pursuant to 35 U.S.C. Secs. 119 and/or 120. This application is also a continuation in part of and claims the benefit of priority under 35 U.S.C. Sections 119 and 120 to U.S. patent application Ser. No. 10/294,017 filed Nov. 13, 2002 which claims priority to Provisional Application No. 60/337,498 filed Nov. 13, 2001. This application is also a continuation in part of and claims the benefit of priority under 35 U.S.C. Sections 119 and 120 to U.S. patent application Ser. No. 10/806,833 filed Mar. 22, 2004 and U.S. patent application Ser. No. 29/276,253 filed Jan. 19, 2007 and U.S. patent application Ser. No. 29/276,249 filed Jan. 19, 2007. The disclosures of all of the foregoing applications are incorporated by reference herein in their entirety as if fully set forth herein. Also incorporated herein by reference in its entirety as if fully set forth herein is Applicant's non-provisional application being concurrently filed this same date entitled Home Arc Exercise Machine.

Also incorporated herein by reference in their entireties as if fully set forth herein are the disclosures of published applications having publication numbers 2003-0092532 published May 15, 2003 (corresponding to Ser. No. 10/294,017) and 2004-0224825 published Nov. 11, 2004 (corresponding to Ser. No. 10/806,833).

FIELD OF THE INVENTION

The present invention relates to physical exercise machines and more particularly to an exercise apparatus that enables users to perform a simulated walking, running or other back and forth leg movement exercise.

BACKGROUND OF THE INVENTION

Exercise machines for simulating walking or running are known and used for directing the movement of a user's legs and feet in a variety of repetitive paths of travel. Machines commonly referred to as elliptical path machines have been designed to pivot the foot pedals on which the user's feet reside causing the pedals and the user's feet to travel in an elliptical or arcuate path. The foot supports are typically disposed between a pair of pivoting support arms that support the foot pedals and the user when standing on the foot pedals. The angular degree of pivoting of the foot pedals as the foot pedals travel from back to front and front to back along the path of travel or translation of the pedals typically varies by more than about 3 degrees and more typically more than about 10-30 degrees.

SUMMARY OF THE INVENTION

In accordance with the invention there is provided an exercise device comprising:

a foot support arranged on a frame for supporting a user standing upright on the foot support, the foot support being movable on the frame back and forth between a rearward position and a forward position along any one of a plurality of separate, reproducible user selectable segments of an overall arcuate path;

the foot support being supported in a cantilevered arrangement on a rear linkage that is pivotally mounted on the frame for back and forth movement.

The rear linkage can form one of the linkages of a four bar linkage, the four bar linkage further comprising a bottom linkage and a front linkage that are pivotally interconnected to the rear linkage for back and forth movement, the foot support being mounted on or to the bottom linkage in the cantilevered arrangement rearward of the rear linkage.

The front linkage of the four bar linkage is typically connected to an arm that reciprocally rotates together with the back and forth movement of the front linkage, the arm being interconnected to a resistance mechanism.

The resistance mechanism typically comprises a wheel mechanism.

The arm is pivotally interconnected to a link that is pivotally interconnected to the resistance mechanism.

The machine can include a manually graspable input arm pivotably interconnected to the foot support such that the arm pivots forwardly together with forward and upward movement of the foot support and rearwardly together with backward and downward movement of the foot support.

The foot support can be mounted for movement back and forth between a rearward down position and a forward up position.

In another aspect of the invention there is provided an exercise device comprising:

a frame supporting a frame linkage assembly;

left and right foot supports suspended on the frame linkage assembly for pivoting movement of the foot supports and the frame linkage assembly along a back and forth overall arcuate path;

the frame linkage assembly being connected to an arm that is reciprocally rotated back and forth together with the back and forth movement of the frame linkage assembly, the arm being pivotally interconnected to a resistance assembly.

Such a machine can include a pair of left and right manually graspable input arms pivotably interconnected to a respective one of the left and right foot supports such that the left arm pivots forwardly together with forward movement of the left foot support and rearwardly together with backward movement of the left foot support and such that the right arm pivots forwardly together with forward movement of the right foot support and backwardly together with backward movement of the right foot support.

Further in accordance with the invention there is provided an exercise device comprising:

a frame supporting a frame linkage assembly;

left and right foot supports suspended on the frame linkage assembly for pivoting movement of the foot supports and the frame linkage along a back and forth overall arcuate path;

the frame linkage assembly being connected to a first arm that is reciprocally rotatable back and forth less than 360 degrees in each direction together with the back and forth arcuate movement of the frame linkage assembly, the arm being pivotally interconnected to a second arm that is drivably rotatable 360 degrees by the back forth rotation of the first arm.

Also in accordance with the invention there is provided a method of performing a back and forth foot motion exercise comprising:

standing on a pair of left and right foot supports of an exercise machine in a generally upright position, the foot supports being suspended on a frame of the exercise machine by a frame linkage assembly for movement back and forth along an arcuate path;

connecting the frame linkage assembly to a first arm that rotates reciprocally back and forth together with back and forth movement of the frame linkage assembly;

pivotally interconnecting the first arm to a second rotatable arm such that the second rotatable arm is rotated as the first arm is rotated;

forcibly driving the foot supports back and forth with a user's feet together with the frame linkage assembly such that the first arm is reciprocally rotated back and forth and the second arm is rotated by the reciprocal rotation of the first arm.

Typically the method includes disposing the foot supports in a cantilevered relationship on the frame linkage assembly.

And, the method can include preselecting one of a plurality of reproducible segments of the arcuate path through which the foot supports are forcibly driven.

BRIEF DESCRIPTION OF THE DRAWINGS

The above and further advantages of the invention may be better understood by referring to the following description in conjunction with the accompanying drawings in which.

DETAILED DESCRIPTION

Generally, the present invention is an exercise apparatus that provides one or more foot supports arranged in a cantilevered fashion on linkages suspended on a frame, the foot supports being movable along an arcuate path and typically defined around a point of rotation. The arcuate path is divisible into a plurality of discrete, reproducible from front to back and back to front, machine defined, user selectable arc segments. The exercise apparatus includes a frame, a frame linkage movably engaged with the frame, one or more foot supports movably engaged with the frame linkage, a bell crank or drive arm connected to the frame linkage for back and forth reciprocal movement along a typically less than 360 degree arc, a resistance mechanism pivotally interconnected to the bell crank or arm via a crank that is typically rotatable 360 degrees and connected to the resistance mechanism for resistance against the rotation. The apparatus preferably includes a tilt mechanism operative to move or tilt the location of the resistance mechanism and the 360 degree rotative crank with respect to the linkage assembly and foot supports.

Figure 1:
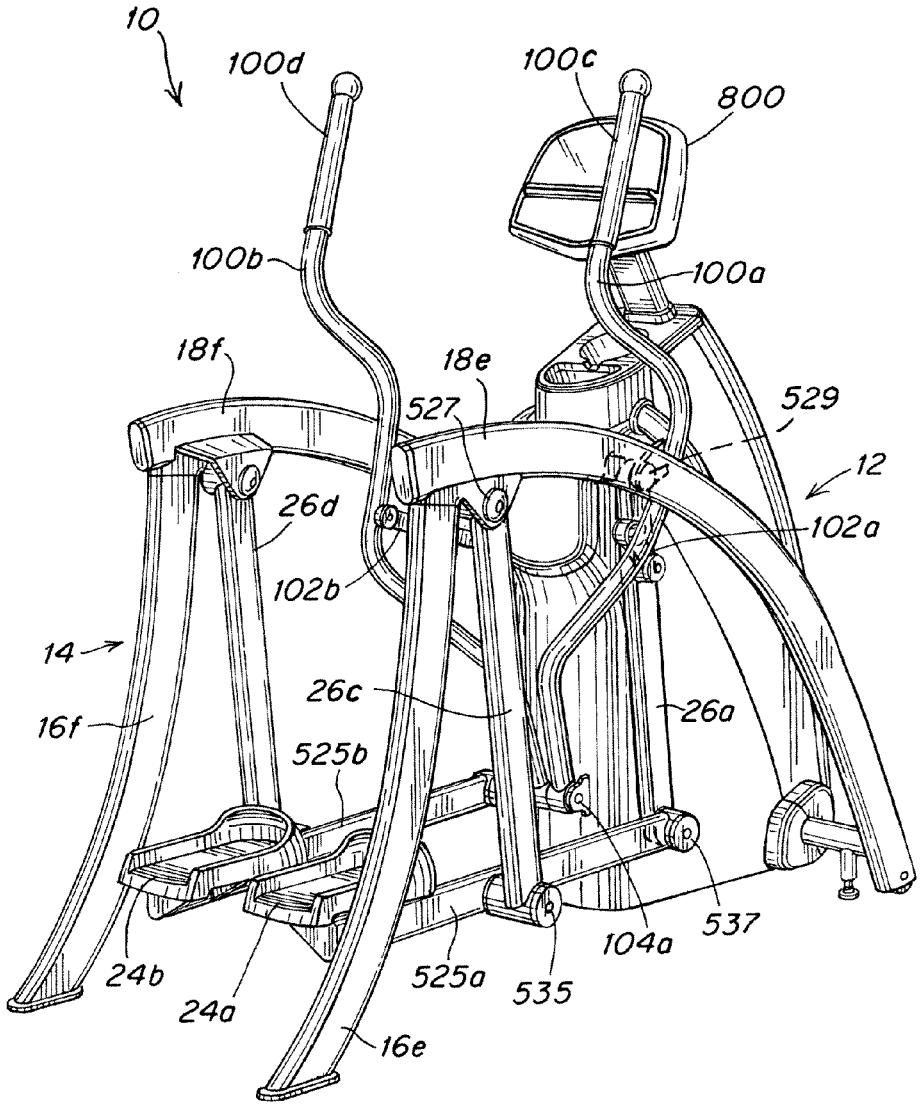
FIG. 1 is a rear perspective view of a device in accordance with the invention.
Figure 2:
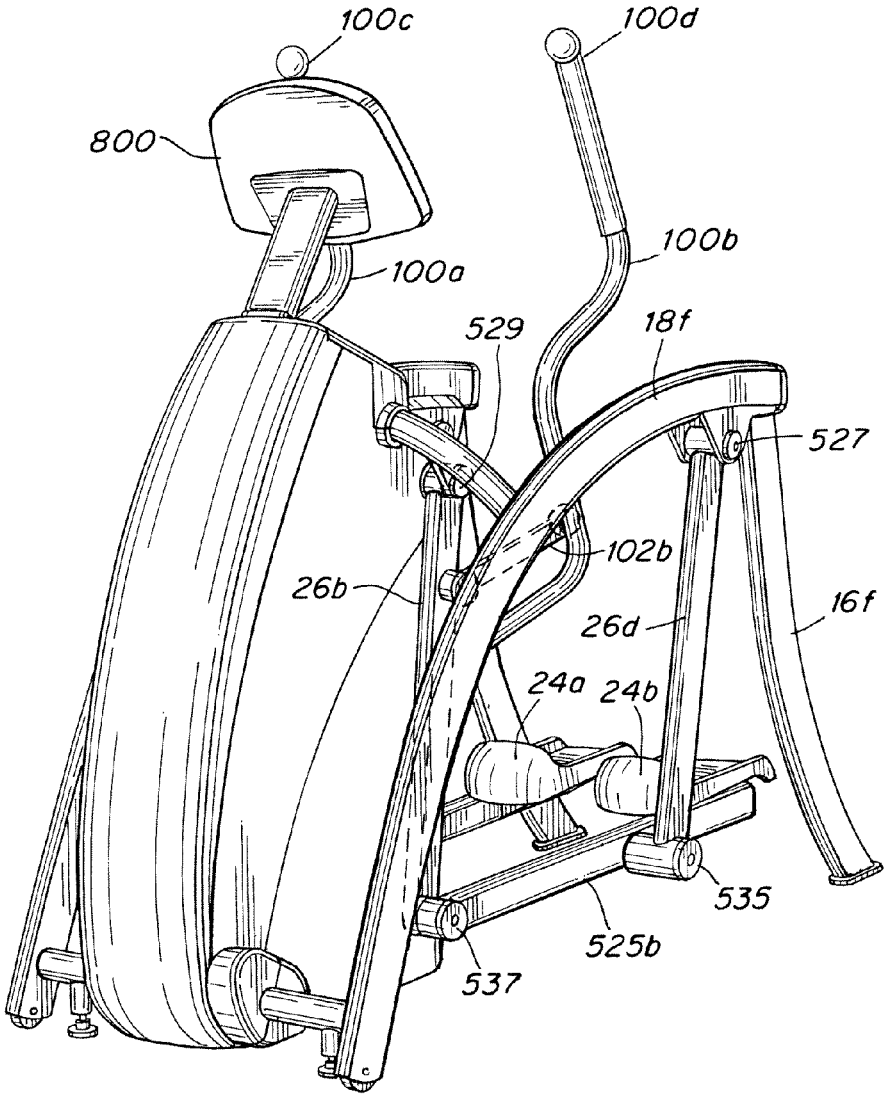
FIG. 2 is a front perspective view of the device of FIG. 1.
Figure 3:
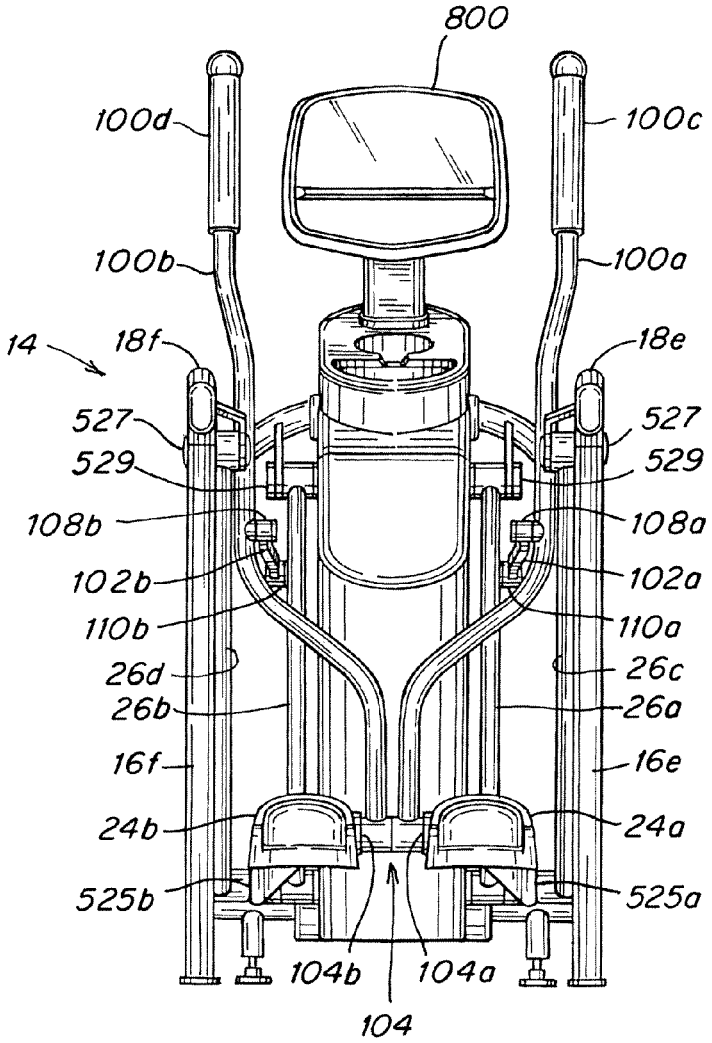
FIG. 3 is a rear view of the device of FIG. 1.
Figure 4:
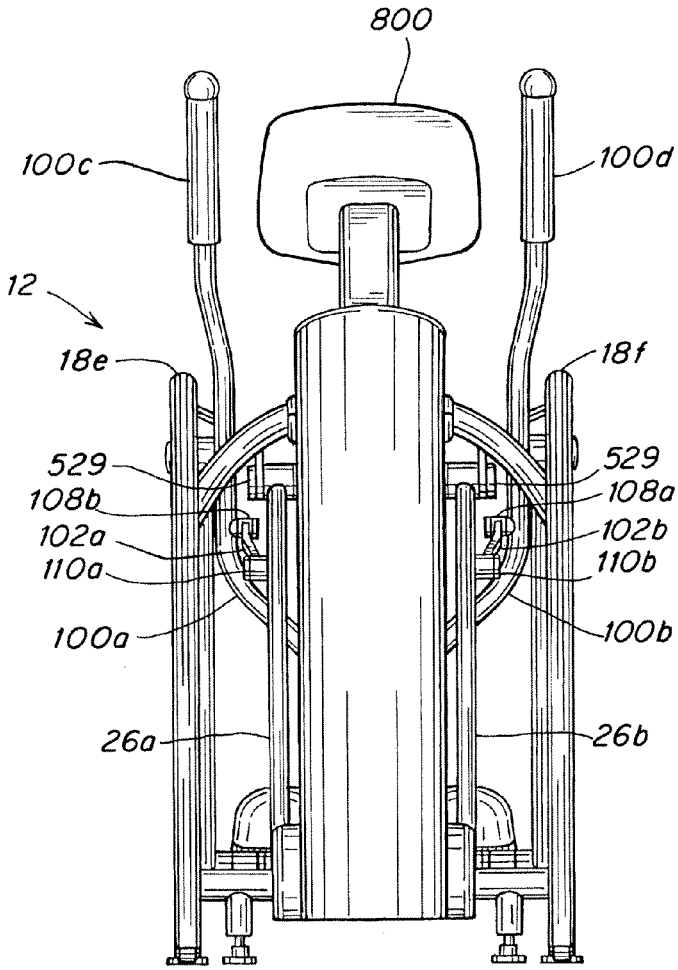
FIG. 4 is a front view of the device of FIG. 1.

There is shown in FIG. 1 an exercise device or machine 10 in accordance with the invention. The machine includes a frame 20 having a front region 12, a rear region 14, legs 16*e*, 16*f* and upper supports 18*e*, 18*f*. Upper frame supports 18*e* and 18*f* comprise the upper links of a pair of four bar linkages. The upper supports are rigidly connected to legs 16*e* and 16*f* respectively and collectively comprise an integral part of frame 20. A display/control panel 800 is rigidly connected to the frame 20 and disposed at the forward 12 end of the machine 10. A pair of right and left force/energy input arms 100*a*, 100*b* with upper end hand grips 100*c*, 100*d* are pivotally mounted on the frame at pivot points 104*a*, 104*b* for back and forth movement from front to back and back to front. The input arms 100*a*, 100*b* are pivotally interconnected to drive linkages 102*a*, 102*b* at pivot points 108*a*, 108*b*, the drive linkages in turn being pivotally connected to front frame assembly linkages 26*a*, 26*b* at pivot points 110*a*, 110*b*.

Foot supports 24*a* and 24*b* are sized to receive the foot of a user and are suspended on the frame 20 by a frame linkage assembly for front to back, back to front reciprocal movement under the force of a user's exerting a backwardly or forwardly directed force on the foot supports using the user's leg and hip muscles. The frame linkage assembly comprises forward linkages or legs 26*a* and 26*b*, and rear linkages 26*c* and 26*d*. Linkages 26*a*-26*d* are movably/pivotally connected to the upper support arms 18*e*, 18*f* of frame 20 at pivot points 527, 529. The foot supports 24*a* and 24*b* are mounted on lower linkages 525*a*, 525*b* which are in turn movably/pivotally connected to the frame assembly linkages 26*a*-26*d* at pivot points 531, 533, 535, and 537. Collectively, the linkages 26*a-d*, 525*a-b* and 18*e-f* comprise a four bar linkage. Although the device is shown as a four bar linkage with opposing pairs of linkages supporting each foot support, other embodiments are contemplated having fewer or more linkages supporting and controlling the range and path of motion of foot supports 24*a* and 24*b* associated with the linkage(s).

The foot supports 24*a* and 24*b* approximate a shoed human foot in size and shape. They can include a non-skid surface and be bounded by one or more low lips to help a shoe remain in place on the foot supports during use. Alternately, straps may maintain each foot within the foot support to further retain the user's foot in place during use. However, as used herein, a "foot support" can also encompass any designated support such as a pedal, a pad, a toe clip, or other foot/toe/leg and device interface structure as is known in the art. As shown, the sole receiving surface of the foot supports faces vertically upward and the supports 24*a*, 24*b* are mounted on the top surfaces of lower linkages 525*a*, 525*b* such that a user must stand on the foot supports in a generally vertically upright disposition and can forcibly move the foot supports together with the frame linkages in a generally horizontal front to rear and rear to front direction by pushing forwardly or pulling backwardly on the foot pedals by use of the user's leg and hip and associated muscles.

Figure 8:
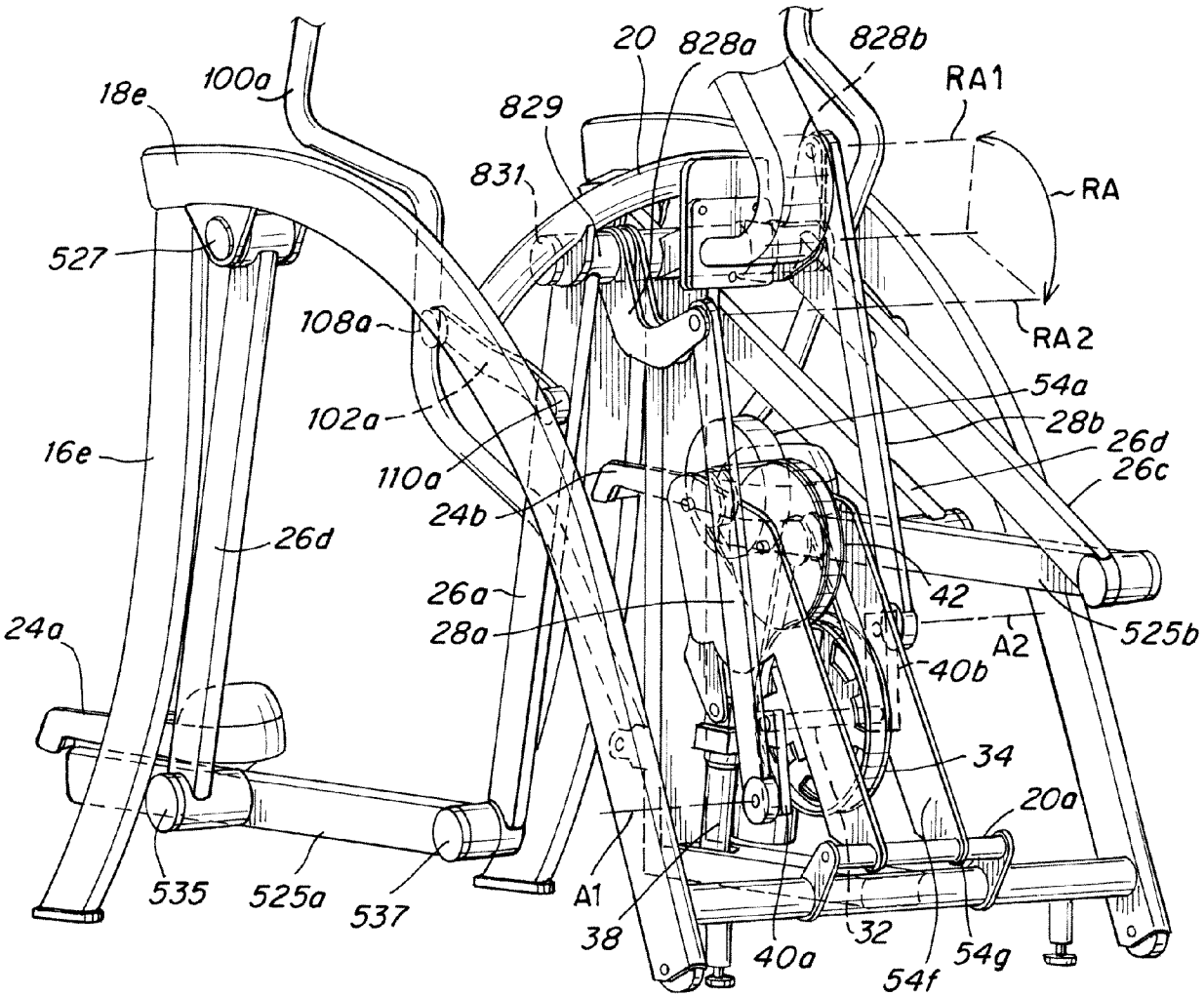
FIG. 8 is a right side perspective view of the FIG. 7 side view.
Figure 9:
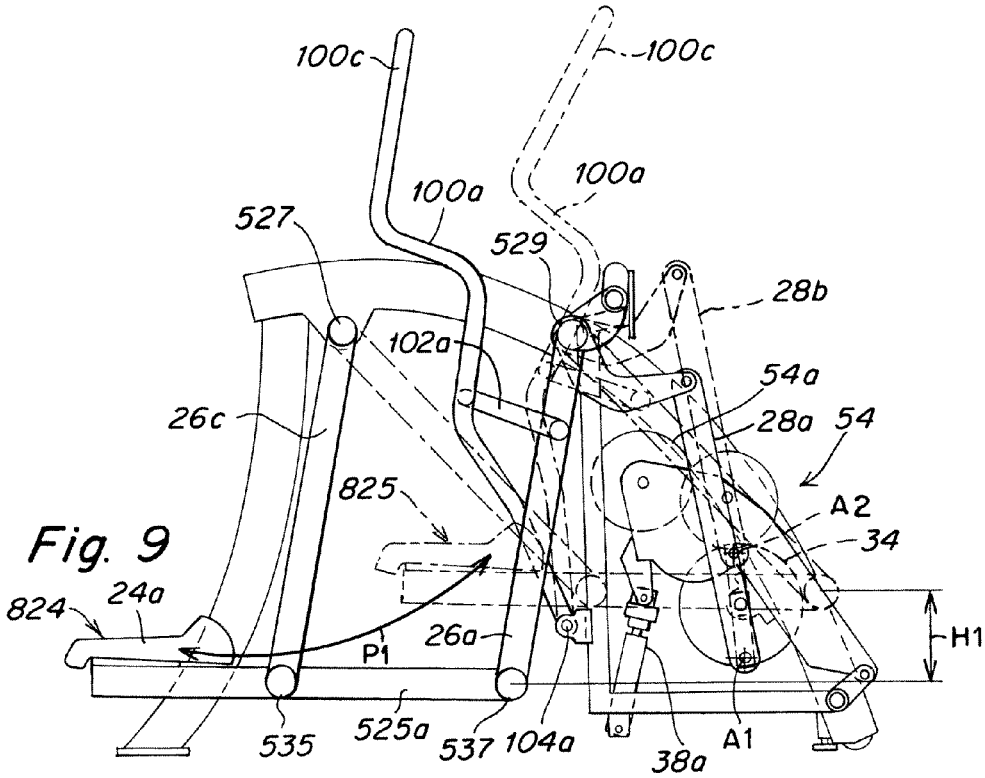
FIG. 9 is a right side view of the FIGS. 1-8 embodiment showing the foot pedal and the links that suspend the foot pedal on the frame in their forwardmost and rearwardmost positions when the resistance flywheel and associated assembly are positioned in a more backwardly, downwardly pivoted position where axis X of the flywheel mounting member is in a retracted nearly vertical orientation.
Figure 10:
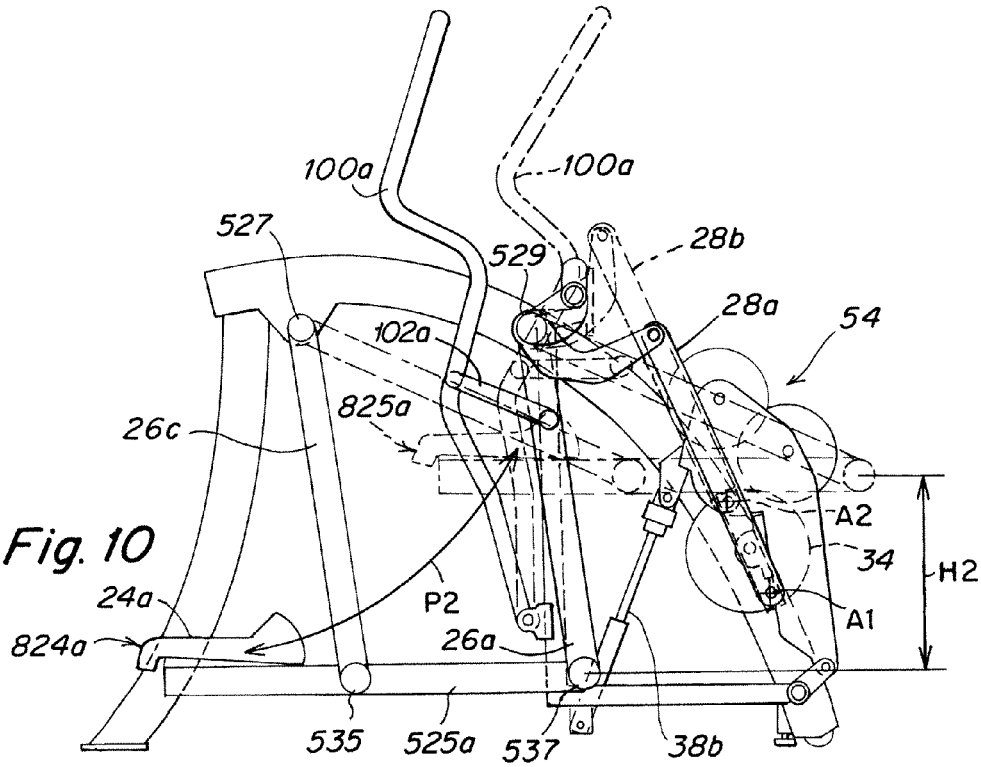
FIG. 10 is a right side view of the FIGS. 1-8 embodiment showing the foot pedal and the links that suspend the foot pedal on the frame in their forwardmost and rearwardmost positions when the resistance flywheel and associated assembly are positioned in a more forwardly, upwardly pivoted position where axis X of the flywheel mounting member is in an extended less vertical orientation.

The forward linkages or legs 26*a* and 26*b* of the linkage assembly are rigidly connected to a bell crank or arm 828*a*, 828*b* via a tubular shaft 829 that is rotatably mounted on a bar or tube 831 that is fixedly/rigidly connected to the frame 20. The bell crank 828*a*, 828*b*, FIG. 8, is reciprocally pivotable or rotatable back and forth/up and down through a less than 360 degree arc RA between upwardmost RA1 and downwardmost RA2 positions. The right and left crank arms 40*a*, 40*b* are arranged on the shaft of the flywheel 180 degrees out of phase relative to each other such that the right 828*a* and left 828*b* bell crank arms are disposed at the uppermost RA1 and downwardmost RA2 positions relative to each other at when the crank arms 40*a*, 40*b* are at two most opposing positions during the course of the 360 degree rotation of the crank arms 40*a*, 40*b*. As shown in FIGS. 9, 10, the foot supports 24*a*, 24*b* and associated frame linkages, 26*a-d*, move along discrete reproducible selected segments P1, P2 of an overall arcuate path defined by the arrangement and configuration of the frame, the linkages, the foot supports and associated machine components. As shown, the foot supports travel between reardwardmost/downwardmost 824, 824*a* (shown in solid lines) and forwardmost/upwardmost 825, 825*a* (shown in dashed lines) positions during the course of an exercise cycle along the selected arc segments P1, P2.

FIG. 9 shows the apparatus with the flywheel resistance assembly 54 in a user selectable/selected downwardmost position, the driven tilt mechanism 38*a* being shown in its most retracted position as preselected by the user's operation of the user operation interface 800. The tilt mechanism 38, as shown in FIGS. 8-10 is pivotally connected to the flywheel/resistance assembly 54 and has a driven shaft that is controllably extendable to pivot the resistance assembly 54 between retracted 38*a* and extended 38*b* positions, FIGS. 9, 10, and to any selected extended position in between the positions shown in FIGS. 9, 10. The flywheel/resistance assembly is mounted on arms 54*f* that are in turn pivotally mounted at a pivot point 54*g* on a frame member 20*a*. The user can controllably select the degree of extension of the tilt mechanism 38 by operation of a motor or other conventional electrically controllable mechanism (not shown) that is connected to and controls the operation of the tilt mechanism 38. The degree incline of the arcuate path of travel of the foot supports such as P1, P2 can thus be controllably varied by virtue of the interconnection of the crank arms 40*a*, 40*b* of the resistance assembly 54 to the frame linkage assembly arms 26*a*, 26*b* and to the frame linkage generally. In the position of tilt as shown in FIG. 9 the foot supports and associated linkages travel along a less steep, less inclined arc segment P1 having a smaller vertical height of travel relative to the arc segment P2 having a steeper arcuate path with a longer vertical height of travel H2 shown in FIG. 10. As can be readily imagined, any arcuate path of lesser or greater incline between P1 and P2 can be selected by controllable selection of the degree of tilt of tilt mechanism 38.

As shown in FIGS. 9, 10 the foot supports travel between a downwardmost and rearwardmost position 824, 824*a* (solid lined) and a forwardmost and upwardmost 825, 825*a* position. As forward linkages 26*a*, 26*b* travel from back to front and front to back, the bell cranks 828*a*, 828*b* to which the linkages 26*a*, 26*c* are rigidly interconnected via shaft 829 are reciprocally rotated back and forth along a less than 360 degree (typically less than about 45 degrees, typically between about 5 and about 30 degrees) arcuate path RA, between RA1 and RA2. The shaft 829 and the bell cranks 828*a*, 828*b* reciprocally rotate or pivot along with the back and forth movement of forward linkages 26*a*, 26*c* and the frame linkage assembly generally. The less than 360 reciprocal rotation of the bell cranks 828*a*, 828*b* between the upwardmost RA1 and downwardmost RA2 positions effects a complete 360 rotation of the crank arms 40*a*, 40*b* and thus a complete 360 degree rotation of the shaft 32 of the pulley 34. Thus a complete forward to back, back to forward movement of the frame assembly and foot supports 24*a*, 24*b* along a selected arcuate path such as P1 or P2 effects a complete 360 degree rotation of the shaft 32 of the pulley 34 via the pivotal interconnections of the frame assembly and bell cranks to the crank arms 40*a*, 40*b* and the resistance mechanism 54 generally.

Monitor 800 may include displays and controls to allow the user to manipulate the intensity of the resistance to create an easier or more difficult exercise routine and to adjust the motion path of the foot supports to one that is more inclined or less inclined.

Although the brake/flywheel assembly 54 is one embodiment, various other braking devices such as known to those skilled in the art can be interconnected to the bell cranks 828*a*, 828*b* to inhibit rotation or pivoting thereof. The braking device may include but is not limited to any of the following: friction and air resistance devices such as fans, pneumatic or hydraulic devices, as well as various other types of electromechanical braking devices. This list is by no means exhaustive and represents only a few examples of resistance mechanisms that may be incorporated into the present invention. The configuration disclosed herein, i.e. use of a flywheel assembly 54 with crank arms 40*a*, 40*b* is one embodiment.

In operation, a user approaches the device from the rear region 14, grasps the hand grips 100*c* and 100*d*, and places a foot on each of the foot supports 24*a* and 24*b*. The user's feet and legs begin to move fore and aft in a comfortable stride. The user selects an exercise program or manually adjusts the device by imputing commands via the display/control panel 800. In response to the command input, the resistance to fore and aft movement of the foot supports 24*a* and 24*b* can be altered by impeding rotation of the pulleys 34, 42 or the flywheel. Also, in response to command input, the mounting 38 is moved fore or aft. As shown, when the mounting 38 moves forward, the motion path of the foot supports is on a more inclined or vertical defined arc segment. To discontinue use of the device, a user simply stops striding, thereby causing the movement of the device to stop, and dismounts from the foot supports.

The foot supports and the frame linkages are typically mounted/arranged on the frame such that the degree of rotation or pivot of the foot supports 24*a*, 24*b* from back to front and front to back along the arcuate path of translation of the foot pedal from front to back and vice versa is less than about 3 degrees, typically less than about 2.5 degrees. The foot pedals have a foot sole receiving upper surface that defines a generally planar orientation or plane in which the sole of the foot of the user is maintained when standing on a foot pedal.

A pair of pivoting upper body input arms 100*a*, 100*b* are provided that the user can manually grasp by hand at an upper region such as handles 100*c*, 100*d*, the handles being a rigidly connected extension of arms 100*a*, 100*b* respectively and moving/pivoting together with the arms forward or backward. The handles 100*c*, 100*d* and arms 100*a*, 100*b* are pivotably interconnected to the frame and to the pedals. As shown the arms 100*a*, 100*b* are pivotably interconnected to the frame 20 via a pivot mount member 104 that is connected to the frame 20, the bottom ends of the arms 100*a*, 100*b* being freely pivotably mounted via pin/aperture joints 104*a*, 104*b* at their bottom ends. Arm linkage members 102*a*, 102*b*, are pivotably attached at one end to the arms at joints 108*a*, 108*b* which allow the linkage members to rotate/pivot on and with respect to the arms and pivotably attached at another end to the forward longitudinal four bar linkage members 26*a*, 26*b* respectively via joints 110*a*, 110*b* that allow the linkage members 26*a*, 26*b* to rotate around the axes of the joints.

As shown in FIGS. 9, 10 as the foot supports 24*a*, 24*b* and frame linkage assembly travels from either front to back or from back to front, the handles 100*c, d* and arms 100*a, b* follow the front to back movement of the pedals 24*a*, 24*b* with a pivoting front to back or back to front movement. That is, when the right pedal 24*a* moves forwardly the right handle 100*c* and arm 100*a* pivot or move forwardly; when the right pedal 24*a* moves backwardly the right handle 100*c* and arm 100*a* pivot or move rearwardly, FIGS. 9, 10; similarly when the left pedal 24*b* moves forwardly the handle 100*d* and arm 100*b* pivot or move forwardly; when the left pedal 24*b* moves rearwardly the handle 100*d* and arm 100*b* pivot or move rearwardly. As shown the frame linkage assembly generally moves forwardly and backwardly together with forward and backward movement of the input handles and arms. The degree of front to back pivoting of the arms 100*a, b* can be predetermined at least by selective positioning of the pivot joints 108*a*, 108*b*, 110*a*, 110*b*, selective positioning of the mount 104 and selection of the lengths of linkage arms 102*a*, 102*b*.

In the FIGS. 9, 10 embodiments, the user can reduce or transfer the amount of energy or power required by the user's legs and/or feet to cause the foot pedals to travel along the arcuate path P1, P2 from back to front by pushing forwardly on the upper end of the arms 100*a*, 100*b* during the back to front pedal movement. And, the user can increase the speed of forward movement by such pushing; or reduce the speed and increase the power or energy required by the legs to effect forward movement by pulling. Conversely the user can reduce or transfer the amount of power or energy required to cause the pedals to move from front to back by putting backwardly on the upper end of the arms. And, the user can increase the speed of rearward movement by such pulling or reduce the speed by pushing; or reduce the speed and increase the power or energy required by the legs to effect rearward movement by pushing.

The linkage and foot support assemblies, 24*a-b*, 26*a-d*, 18*e-f* that are pivotably linked via the linkages 102*a*, 102*b* to the pivotably mounted arms 100*a, b* can be configured to enable the foot pedal and the plane in which the sole of the foot is mounted to either not rotate or to rotate/pivot to any desired degree during front to back movement by preselecting the lengths of each and any of the links 26*a-d*, 18*e-f* appropriately to cause the desired degree of rotation/pivoting.

In the embodiments shown, the drive linkages 28*a* and 28*b* are interconnected to the flywheel 54*a* at opposing 180 degree circle positions A1, A2 from the center of rotation of the shaft 32 and crank arms 40*a, b* of pulley 34, i.e. the linkages are connected at maximum forward and maximum rearward drive positions respectively. This 180 degree opposing interconnection causes the right 24*a* and left 24*b* foot pedals to always travel in opposite back and forth translational directions, i.e. when the right pedal is traveling forward the left pedal is traveling backwards and vice versa. Similarly, the pivotably mounted arms 100*a* and 100*b* are interconnected to the flywheel 54*a* such that when the right arm is moving forward the left arm is moving backward and vice versa. As shown in FIGS. 9, 10 the arms 100*a*, 100*b* travel forwardly or backwardly together with their associated foot supports 24*a* and 24*b* respectively.

In any event, the right side and left side pedals 24*a, b* and input arms 100*a, b* are linked to the resistance or drive assembly (in the embodiments shown, the flywheel and associated crank arms) such that when the left side components (i.e. left pedal and associated input arm) are traveling forward the right side components (i.e. right pedal associated input arm) are traveling backward for at least the majority of the travel path and vice versa.

The upper body input arms 100*a, b* are interconnected or interlinked to the same pivotable mounting member 38 as described above via the links 102*a, b*, four bar linkage members 26*a, b* and links 28*a, b*. In the same manner as forward or backward pivoting of the mounting member 38 changes the degree of incline, height and/or path of travel of foot pedals 24*a, b* as described above, a forward or backward pivoting of the mounting member 38 also changes the degree of back to front pivoting and/or the degree of path of travel of arms 100*a, b*. Thus, in the same manner as the user is able to select the degree of incline of the path of travel of the foot pedals, e.g. arc path P1, P2, the user is able to select the degree, length, path of travel of back to front, front to back pivot stroke or travel path of input arms, 100*a, b*, by adjusting the front to back pivot position of the linkage 102*a, b*.

Figure 5:
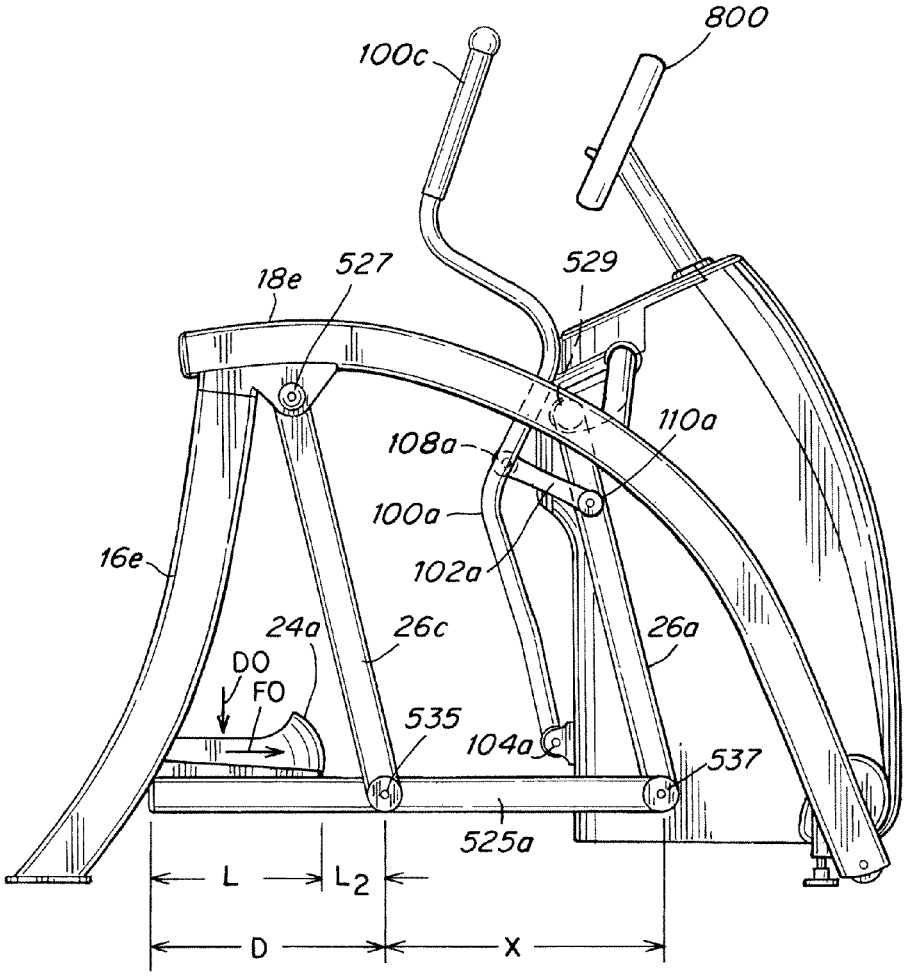
FIG. 5 is a right side view of the device of FIG. 1.
Figure 6:
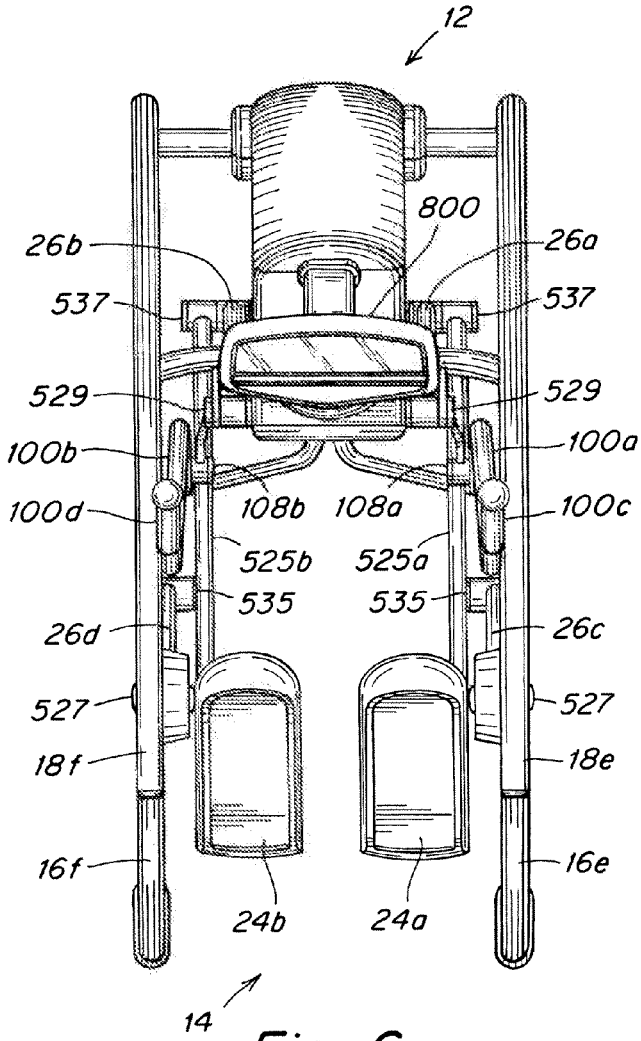
FIG. 6 is a top plan view of the device in FIG. 1.
Figure 7:
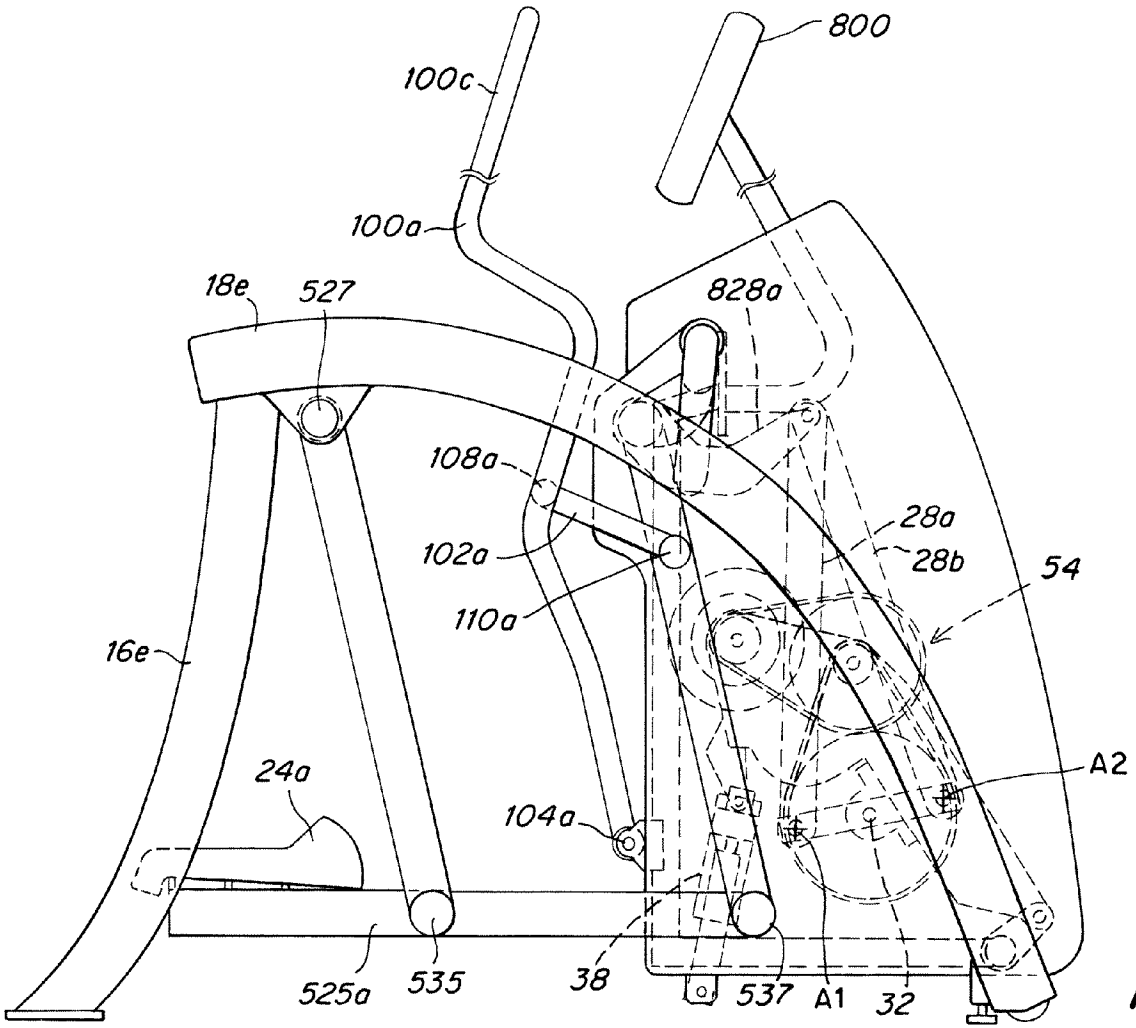
FIG. 7 is a side view of the FIG. 1 apparatus showing in dashed line the mounting and pivotal connection relationships of the front linkage, crank arm and wheel crank components of the apparatus.

As shown, e.g. in FIG. 5, the vertically disposed links 26*a-d* of the four bar linkage are pivotally connected and supported at upper pivot points, e.g. points 527, 529 on the frame members 18*e-f* and pivotally connected to the lower linkages 525*a-b* at lower pivot points, e.g. points 535, 537.

As shown in the FIGS. 1-10 embodiments, the longitudinal lengths L of the footplates 24*a*, 24*b* extend beyond and rearwardly of the lower inside lengths X of the lower four bar linkages 525*a*, 525*b* and thus beyond, i.e. rearwardly of the pivot points 535 at which the lower linkages 525*a-b*, are pivotally connected to the rear linkages 26*c-d*. By such an arrangement, the footplates 24*a* and 24*b* are cantilevered in their structure, function and movement relative to the four bar linkage assembly around lower pivot points 535. The load exerted on foot supports 24*a-b* by a user as shown is supported primarily by rear linkages 26*c-d* at the pivot connections 535.

The degree of leverage or cantileverage force exertable by exertion of a downward force DO on the foot supports 24*a* and 24*b* around the pivot points 535 can be varied by variably selecting the overall distance D, FIG. 15*a*, by which the footplates 24*a*, 24*b* extend beyond the lower pivot points 535 of the four bar linkage assembly. As shown in FIG. 5, the footplates 24*a*, 24*b* are distanced away from the pivot points 535 by an additional distance L2. As shown the front terminal ends of the footplates 24*a* and 24*b* are connected to the rear terminal ends of lower bar or linkages 525*a*, 525*b*, the maximum cantilever distance being essentially the sum of the longitudinal length L and L2. As can be readily imagined, the leverage/cantileverage force can be selectively varied by varying any one or more of the distances L, L2 and concomitantly distance D.

Thus, by mounting or connecting the footplates 24*a* and 24*b* to the lower bar/linkage such that some portion or all of the length of the footplates extend rearwardly or beyond the position of the lower rear pivot points 535 of the four bar linkage, the user is provided with the ability to exert a lever or cantilever force when pushing downwardly DO, FIGS. 14, 15*a*, or forwardly FO, FIG. 5 with the user's legs and/or feet on the top surface of the footplates 24*a* and 24*b*. The degree of such leverage can be selected by preselecting the lengths of one or more of the distances L2, D and L. The longer the cantilever distances D or L2 or L the greater cantilever or lever force that is exertable with the same amount of DO force.

The precise artistic or identifying shape, contour and visual appearance of the structural and functional components of the apparati depicted in all of the Figures in this application is a matter of visual or source identifying design choice, it being understood that many of said structural components can also serve the mechanical functions as described herein.

The invention claimed is:

1. An exercise device comprising:

a foot support arranged on a frame for supporting a user standing upright on the foot support, the foot support being movable on the frame back and forth between a rearwardmost position and a forwardmost position of an overall arcuate path;

the foot support being supported in a cantilevered arrangement on a rear linkage; and an incline selector adjustably interconnected to the cantilevered rear linkage through one or more other linkages, the incline selector being operable by the user to select any one out of a plurality of separate segments of the overall arcuate path, each separate one of the plurality of segments being reproducible and having a separate degree of incline and a separate rearward and forward position determined by the incline selector.

2. The exercise device of claim 1 wherein the rear linkage forms one of the linkages of a four bar linkage, the four bar linkage further comprising a bottom linkage and a front linkage that are pivotally interconnected to the rear linkage for back and forth movement, the foot support being mounted on or to the bottom linkage in the cantilevered arrangement rearward of the rear linkage.

3. The exercise device of claim 2 wherein the front linkage of the four bar linkage is connected to an arm that reciprocally rotates together with the back and forth movement of the front linkage, the arm being interconnected to a resistance mechanism.

4. The exercise device of claim 3 wherein the resistance mechanism comprises a wheel mechanism.

5. The exercise device of claim 3 wherein the arm is pivotally interconnected to a link that is pivotally interconnected to the resistance mechanism.

6. The exercise device of claim 1 further comprising a manually graspable input arm pivotably interconnected to the foot support such that the arm pivots forwardly together with forward and upward movement of the foot support and rearwardly together with backward and downward movement of the foot support.

7. The exercise device of claim 1 wherein the foot support is mounted for movement back and forth between a rearward down position and a forward up position.

8. The exercise device of claim 1 wherein the incline adjuster is connected to the foot support via a bell crank.

9. An exercise device comprising:

a frame supporting a frame linkage assembly;

left and right foot supports suspended on the frame linkage assembly for pivoting movement of the foot supports and the frame linkage assembly along a back and forth overall arcuate path; and the frame linkage assembly being connected to an arm that is reciprocally rotated back and forth together with the back and forth movement of the frame linkage assembly, the arm being pivotally interconnected to a resistance assembly;

further comprising a manually graspable input arm pivotably interconnected to a foot support such that the arm pivots forwardly together with forward and upward movement of the foot support and rearwardly together with backward and downward movement of the foot support, wherein the foot supports are supported in a cantilevered arrangement on the frame linkage assembly.

10. The exercise device of claim 8 further comprising an incline selector adjustably interconnected to the cantilevered rear linkage through one or more other linkages, the incline selector being operable by the user to select any one out of a plurality of separate segments of the overall arcuate path, each separate one of the plurality of segments being reproducible and having a separate degree of incline and a separate rearward and forward position determined by the incline selector.

11. The exercise device of claim 8 wherein the foot supports are mounted for movement back and forth between a rearward down position and a forward up position.

12. The exercise device of claim 9 wherein the frame linkage comprises an arrangement of left and right front, bottom and rear linkages pivotally interconnected to each other, the foot supports being mounted on the bottom linkages rearward of the rear linkage.

13. The exercise device of claim 8 wherein the foot support is connected to the resistance assembly via a bell crank.

14. The exercise device of claim 9 wherein the foot support is connected to the resistance assembly via a bell crank.

15. The exercise device of claim 12 wherein the foot support is connected to the resistance assembly via a bell crank.

16. An exercise device comprising:

a frame supporting a frame linkage assembly;

left and right foot supports suspended on the frame linkage assembly for pivoting movement of the foot supports and the frame linkage along a back and forth overall arcuate path; and the frame linkage assembly being connected to a first arm that is reciprocally rotatable back and forth less than 360 degrees in each direction together with the back and forth arcuate movement of the frame linkage assembly, the arm being pivotally interconnected to a second arm that is drivably rotatable 360 degrees by the back forth rotation of the first arm;

further comprising a manually graspable input arm pivotably interconnected to the foot support such that the arm pivots forwardly together with forward and upward movement of the foot support and rearwardly together with backward and downward movement of the foot support, wherein the foot supports are supported in a cantilevered arrangement on the frame linkage assembly.

17. The exercise device of claim 16 further comprising an an incline selector adjustably interconnected to the cantilevered rear linkage through one or more other linkages, the incline selector being operable by the user to select any one out of a plurality of separate segments of the overall arcuate path, each separate one of the plurality of segments being reproducible and having a separate degree of incline and a separate rearward and forward position determined by the incline selector.

18. The exercise device of claim 16 wherein the foot support is interconnected to a resistance mechanism via a bell crank and second crank.

* * * * *

UNITED STATES PATENT AND TRADEMARK OFFICE

CERTIFICATE OF CORRECTION

PATENT NO. : 8,454,478 B2
APPLICATION NO. : 12/053234
DATED : June 4, 2013
INVENTOR(S) : Raymond Giannelli et al.

It is certified that error appears in the above-identified patent and that said Letters Patent is hereby corrected as shown below:

In the Claims:

In column 10, line 36 (claim 16) after "back" insert -- and --.

Signed and Sealed this
Sixth Day of August, 2013

Teresa Stanek Rea
*Acting Director of the United States Patent and Trademark Office*